US009750362B2

(12) United States Patent
Polubutkin et al.

(10) Patent No.: US 9,750,362 B2
(45) Date of Patent: Sep. 5, 2017

(54) FOLDABLE SPOON

(71) Applicant: OOO <<Kompanija Umnyj DOM>>, Sankt-Peterburg (RU)

(72) Inventors: Andrej Borisovich Polubutkin, Sankt-Peterburg (RU); Alexandr Sergeevich Turkovsky, Moscow (RU)

(73) Assignee: OOOKOMPANIJA UMNYJ DOM, Sankt-Peterburg (RU)

( * ) Notice: Subject to any disclaimer, the term of this patent is extended or adjusted under 35 U.S.C. 154(b) by 0 days.

(21) Appl. No.: 14/440,075

(22) PCT Filed: Dec. 9, 2014

(86) PCT No.: PCT/RU2014/000923

§ 371 (c)(1),
(2) Date: May 1, 2015

(87) PCT Pub. No.: WO2016/003315

PCT Pub. Date: Jan. 7, 2016

(65) Prior Publication Data

US 2017/0135509 A1 May 18, 2017

(30) Foreign Application Priority Data

Jul. 4, 2014 (RU) ..... 2014127313

(51) Int. Cl.

| | |
|---|---|
| ***A47G 21/04*** | (2006.01) |
| ***A47G 21/02*** | (2006.01) |
| *A47G 21/00* | (2006.01) |

(52) U.S. Cl.

CPC ..... *A47G 21/04* (2013.01); *A47G 21/02* (2013.01); *A47G 2021/002* (2013.01)

(58) Field of Classification Search

CPC ..... A47G 21/04; A47G 2021/02
USPC ..... 30/322–324
See application file for complete search history.

(56) References Cited

U.S. PATENT DOCUMENTS

| | | | | |
|---|---|---|---|---|
| 1,128,114 | A * | 2/1915 | Doellinger | A47G 21/04 30/324 |
| 3,828,999 | A * | 8/1974 | Humphrey | A47G 21/04 229/401 |
| 9,131,793 | B2 * | 9/2015 | Cross | A47G 21/04 |
| 2007/0084064 | A1 * | 4/2007 | Fite | A47G 19/02 30/324 |
| 2014/0069933 | A1 * | 3/2014 | Cross | A47G 21/04 220/574 |

(Continued)

FOREIGN PATENT DOCUMENTS

| | | | | |
|---|---|---|---|---|
| FR | 897092 | A * | 3/1945 | A47G 21/04 |
| GB | 2379158 | A * | 3/2003 | A47G 21/04 |
| NL | 1000122 | C2 * | 10/1996 | A47G 21/04 |

*Primary Examiner* — Kenneth E. Peterson
*Assistant Examiner* — John E Grosselin, III
(74) *Attorney, Agent, or Firm* — Inventa Capital PLC

(57) ABSTRACT

A foldable spoon being a flat blank in the initial state, and having two adjacent sections with fold lines carved so as to form a shank and a cup-shaped part in a folded state, wherein between the adjacent sections with fold lines there is a perforated boundary which contacts the fold lines of adjacent sections, the fold lines have elongated holes in the form of slits for fasten purpose arranged in such a way that one section has one hole and the other has two such holes; what is more, the fold line on one of the sections forms a retainer.

8 Claims, 9 Drawing Sheets

(56) References Cited

U.S. PATENT DOCUMENTS

Figure 1:
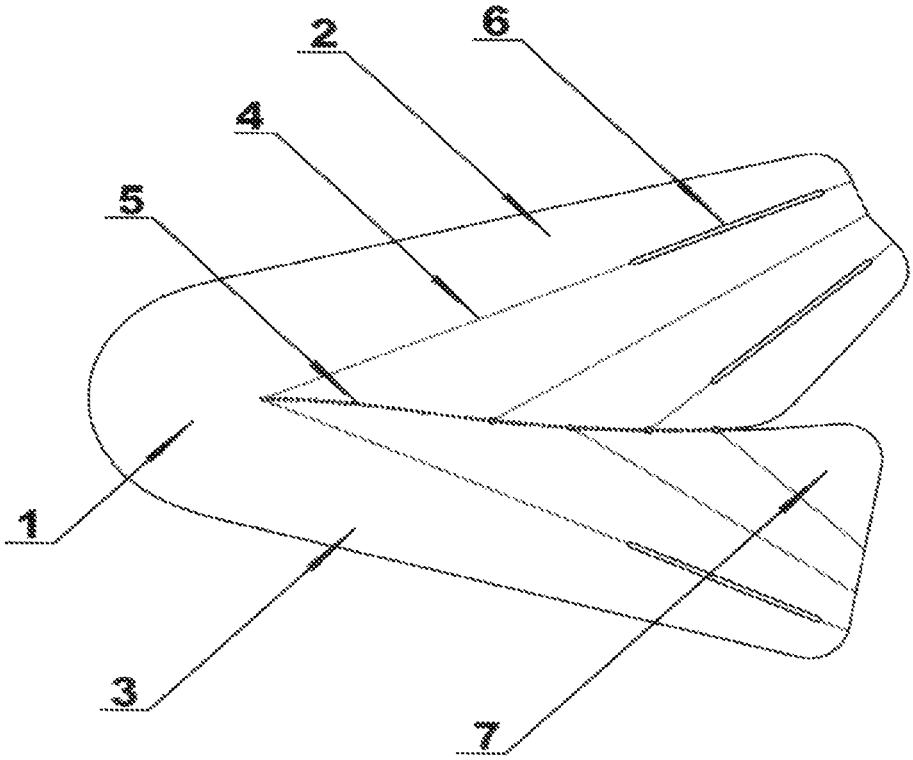

2014/0238987 A1* 8/2014 Brooks ..... B65D 51/246
220/212
2014/0261024 A1* 9/2014 Cross ..... B44C 1/24
101/17

* cited by examiner

FOLDABLE SPOON

RELATED APPLICATIONS

This application claims priority to Patent Cooperation Treaty application number PCT/RU2014/000923, filed on Dec. 9, 2014 which claims priority to Russian patent application serial number 2014127313, filed on Jul. 4, 2014, and incorporated herewith by reference in its entirety.

FIELD OF INVENTION

The claimed utility model relates to the cutlery, and more particularly to a foldable disposable cutlery intended for eating ready-prepared or quick-served products and can be used for eating ready-prepared food products which is especially handy when eating away from home, namely, outdoors or while travelling.

BACKGROUND OF THE INVENTION

There are numbers of known disposable eating utensils available in a folding version. At the same time, the framing of an article of cutlery taking up minimum space is a matter of great importance. For this purpose there are various known disposable articles of cutlery representing flat blank sheets in a disassembled state. There is a known Spoon (U.S. Pat. No. 1,128,114 issued on Feb. 9, 1915), which is in the initial state is a flat blank comprising two adjacent sections with slits fabricated so as to form a shank and a cup-shaped part in the folded state. The shortcoming of the known device is its low manufacturability and reliability in use.

The closest analogue to the claimed device is a set of folding utensils (U.S. Pat. No. 7,637,417 published on Dec. 29, 2009), the known set of folding utensils includes a bowl, a dish, a cup and a spoon which are made of translucent plastic that adds a pleasing appearance to the articles. The spoon is fabricated from a flat sheet having two adjacent sections spliced so as to form shanks and a cup-shaped part in the folded state. The main shortcoming of this known analog is its low manufacturability and reliability in use.

SUMMARY OF THE INVENTION

The claimed utility model provides novel means to circumvent the difficulties described above to achieve such technical results as the manufacturability of the preform as well as the form retention during the whole usage time. The target goal is achieved as follows: the spoon is foldable being a flat blank in the initial state, comprising two adjacent sections with fold lines carved so as to form a shank and a cup-shaped part in the folded state, wherein between the adjacent sections with fold lines there is a perforated boundary which contacts the fold lines of adjacent sections, the fold lines have elongated holes in the form of slits for fasten purpose arranged in such a way that one section has one hole and the other has two such holes; what is more, the fold line on one of the sections forms a retainer.

The claimed utility model ensures an easy manufacturability of the flat blank for the claimed spoon which, for example, can be manufactured using a form die. Moreover, the claimed construction provides the high shape holding capability when using it due to the reliable and firm sections folding along fold lines which maintains a geometrically simple and reliable construction and effective fixation through the slits by the retainer which allows to achieve the claimed technical result, namely, manufacturability of the preform as well as the shape holding capability when using the claimed utility model. The claimed design of the foldable spoon can be successfully applied for manufacturing (including last-volume production) disposable cutlery. It can be used in diverse fields, namely, in pharmacy for taking liquid and bulk drugs and dietary supplements, in household chemistry, animal feeding as well as in the field of construction and renovation materials, etc.

Specifically, the claimed foldable spoon can be characterized by the fact that there are three fold lines formed on each of the adjacent sections.

Specifically, the claimed foldable spoon can be characterized by the fact that the fold lines are formed by the same die as the original flat blank.

Specifically, the claimed foldable spoon can be characterized by the fact that its cup-shaped part has die-cut fork tines.

Specifically, the claimed foldable spoon can be characterized by the fact that the original flat blank is made of food grade plastic.

Specifically, the claimed foldable spoon can be characterized by the fact that the original flat blank is made of food cardboard.

Specifically, the claimed foldable spoon can be characterized by the fact that the original flat blank is made of laminated cardboard.

Foldable spoon in particular can be characterized by the fact that the original flat specimen is made of polystyrene.

Specifically, the claimed foldable spoon can be characterized by the fact that the original flat blank is made of polypropylene.

Figure 2:
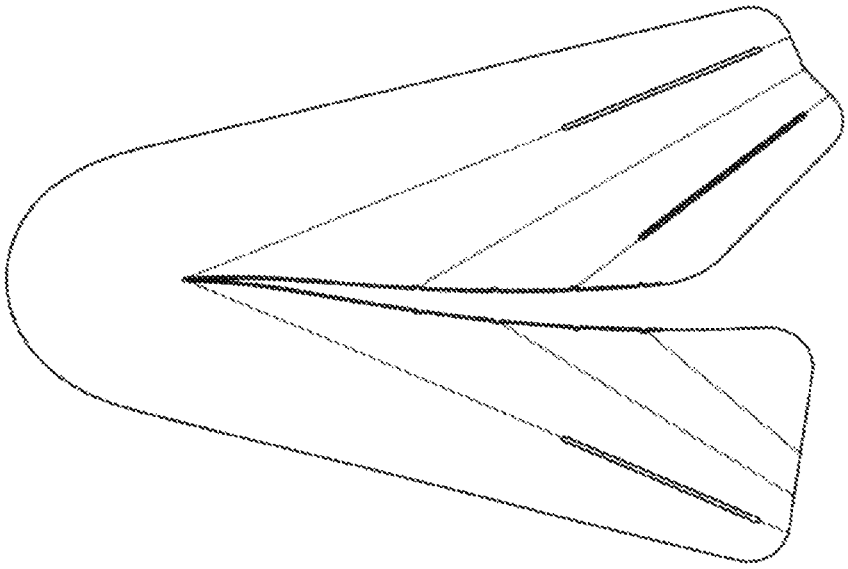
Figure 3:
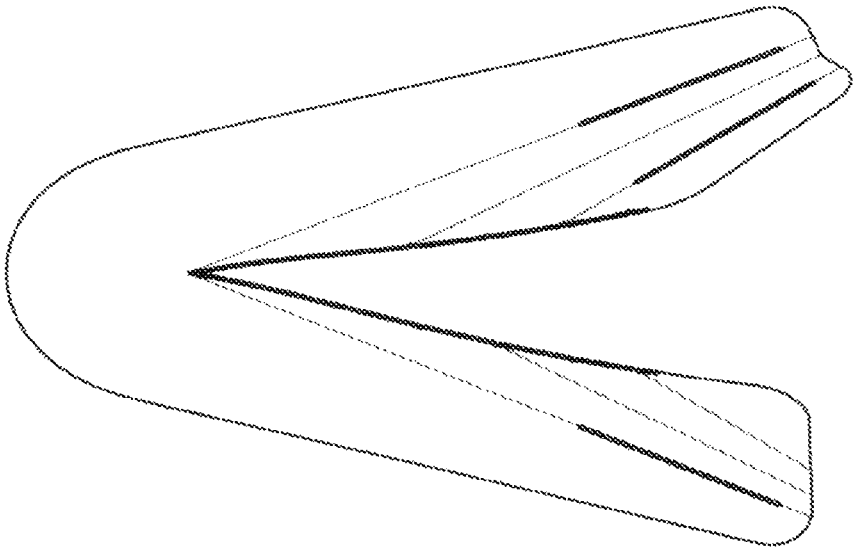
Figure 4:
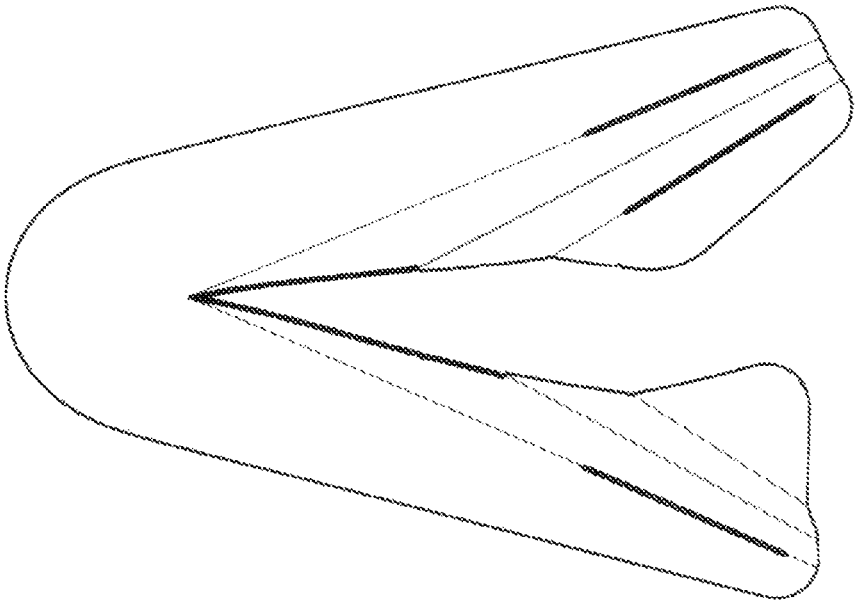
Figure 5:
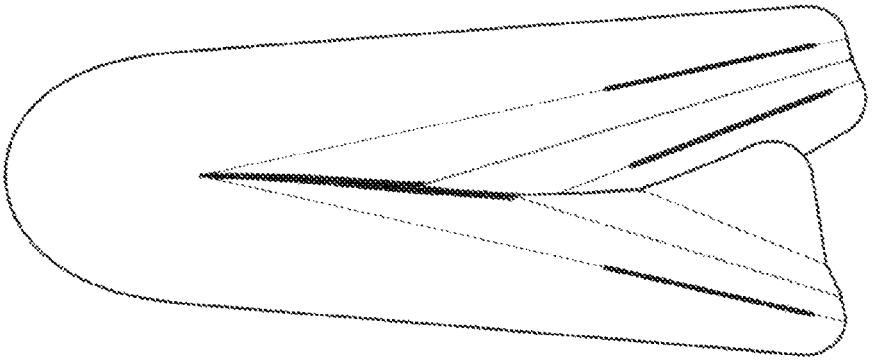
Figure 6:
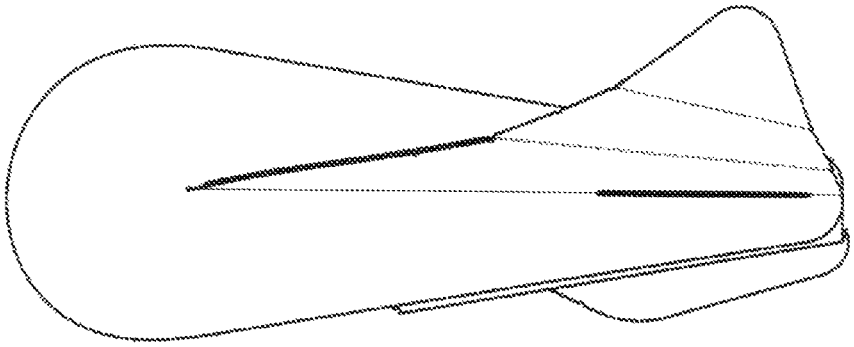
Figure 7:
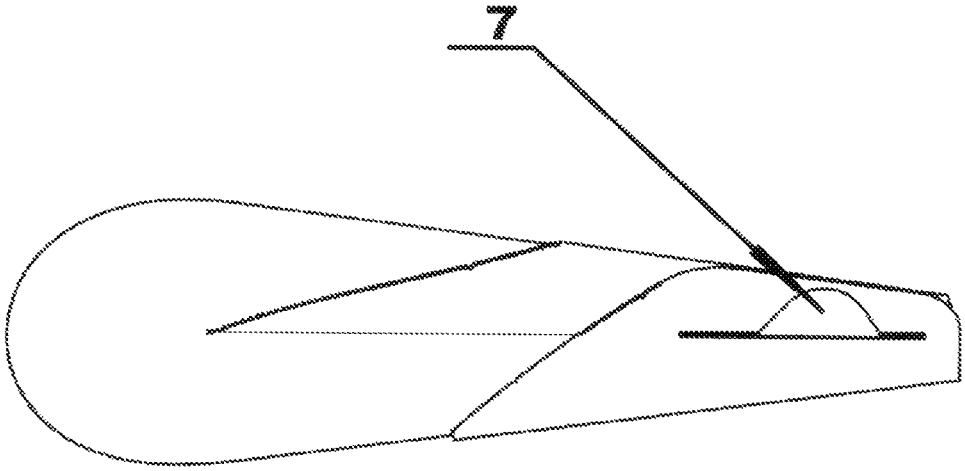
Figure 8:
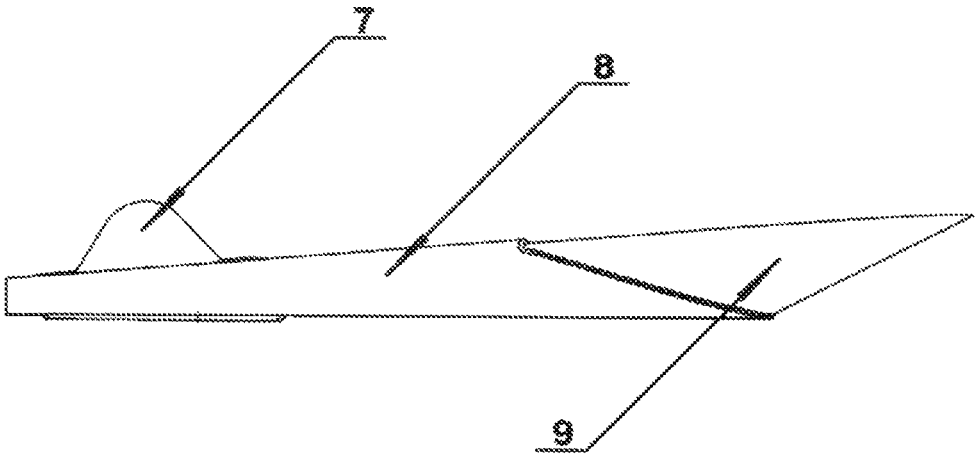
Figure 9:
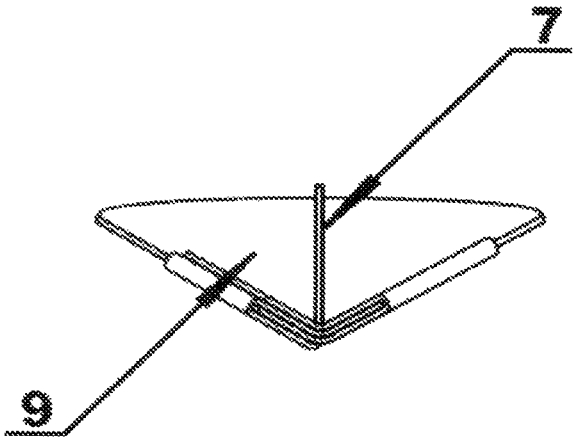

Other advantages of the present invention will be readily appreciated as the same becomes better understood by reference to the following detailed description when considered in connection with the accompanying drawings wherein:

FIGS. 1, 2, 3, 4, 5, 6, 7, 8 and 9 show the foldable spoon, wherein the numbers indicate: 1. Flat blank, 2. First adjacent section, 3. Second adjacent section, 4. Fold lines, 5. Perforated boundary, 6. Elongated holes in the form of slits, 7. Retainer, 8. Shank, and 9. Cup-shaped part. The foldable spoon shown in the figures is structured as follows.

DETAILED DESCRIPTION OF THE INVENTION

Flat blank 1 consists of the first 2 and second 3 adjacent sections. Flat blank 1 has fold lines 4 and perforated boundary 5 separating first 2 and second 3 adjacent sections. Flat blank 1 consists of elongated holes in the form of slits 6 and retainer 7. The foldable spoon shown in the figures works as follows. Originally the claimed spoon is a flat product with preformed fold lines and perforation. The process of the claimed spoon manufacturing begins with the break/fracture of flat blank 1 along perforated boundary 5 resulting in the separation into first 2 and second 3 adjacent sections. After that the blank is folded along fold lines 4 in order to shape an "accordion", thus, automatically forming cup-shaped part 9 of the blank opposite the holes 6.

After that the accordion-folded section 3 is superimposed on the accordion-folded adjacent section 2 so that they match together. At the same time, elongated holes in the form of slits 6 automatically match together, too, so that it became possible to thread retainer 7 through them, thus obtaining securely fastened shank 8.

The above particular properties ensure an easy manufacturability of the flat blank for the claimed spoon which, for example, can be manufactured using a form die. Moreover, the claimed construction provides the high shape holding capability when using it due to the reliable and firm sections folding along fold lines which maintains a geometrically simple and reliable construction and effective fixation through the slits by the retainer which allows to achieve the claimed technical result, namely, manufacturability of the preform as well as the shape holding capability when using the claimed utility model.

The claimed design of the foldable spoon can be successfully applied for manufacturing (including last-volume production) disposable cutlery. It can be used in diverse fields, namely, in pharmacy for taking liquid and bulk drugs and dietary supplements, in household chemistry, animal feeding as well as in the field of construction and renovation materials, etc.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A foldable spoon comprising: a flat blank, comprising two adjacent sections each having with fold lines carved so as to form a shank and a cup-shaped part in a folded state, wherein between the adjacent sections with fold lines there is a perforated boundary which contacts the fold lines of each of the adjacent sections, and at least one of the fold lines on each section has an elongated hole in the form of a slit for fastening purposes arranged in such a way that one section has one hole and the other section has two such holes, wherein each of the holes are aligned in the folded state, and one of the fold lines on one of the sections folds to form a retainer which is inserted through each of the holes in the folded state thereby retaining the shank and cup-shaped part in the folded state.

2. The foldable spoon as set forth in claim 1, wherein there are three fold lines formed on each of the adjacent sections.

3. The foldable spoon as set forth in claim 1, wherein the fold lines are formed by the same die as the original flat blank.

4. The foldable spoon as set forth in claim 1, wherein the flat blank is made of food grade plastic.

5. The foldable spoon as set forth in claim 1, wherein the flat blank is made of food cardboard.

6. The foldable spoon as set forth in claim 1, wherein the flat blank is made of laminated cardboard.

7. The foldable spoon as set forth in claim 1, wherein the flat blank is made of polystyrene.

8. The foldable spoon as set forth in claim 1, wherein the flat blank is made of polypropylene.

* * * * *